US012168822B2

(12) United States Patent
Marshall

(10) Patent No.: US 12,168,822 B2
(45) Date of Patent: Dec. 17, 2024

(54) METHOD OF ANNEALING MULTIPLE INDIVIDUAL ALUMINUM AND COPPER WIRES IN MACHINE LINE IN TANDEM WITH A STRANDING MACHINE FOR CONTINUOUS OPERATION

(71) Applicant: ROTEQ MACHINERY INC., Concord (CA)

(72) Inventor: Michael Marshall, Richmond Hill (CA)

(73) Assignee: ROTEQ MACHINERY INC., Concord (CA)

( * ) Notice: Subject to any disclaimer, the term of this patent is extended or adjusted under 35 U.S.C. 154(b) by 0 days.

(21) Appl. No.: 18/323,777

(22) Filed: May 25, 2023

(65) Prior Publication Data

US 2023/0295788 A1 Sep. 21, 2023

Related U.S. Application Data

(62) Division of application No. 16/685,006, filed on Nov. 15, 2019, now Pat. No. 11,713,501.

(51) Int. Cl.

| | |
|---|---|
| ***C22F 1/08*** | (2006.01) |
| ***B21F 7/00*** | (2006.01) |
| ***C22F 1/04*** | (2006.01) |

(52) U.S. Cl.

CPC ..... *C22F 1/08* (2013.01); *B21F 7/00* (2013.01); *C22F 1/04* (2013.01)

(58) Field of Classification Search

CPC ..... B21F 7/00; C22F 1/08; C22F 1/04
See application file for complete search history.

(56) References Cited

U.S. PATENT DOCUMENTS

| | | | | |
|---|---|---|---|---|
| 1,943,087 A * | 1/1934 | Potter | H01B 13/0214 | 428/592 |
| 4,599,853 A * | 7/1986 | Varga-Papp | H01B 13/0221 | 57/9 |
| 5,554,826 A * | 9/1996 | Gentry | H01B 13/0285 | 174/128.1 |
| 6,045,632 A * | 4/2000 | Sun | C22F 1/04 | 148/695 |

* cited by examiner

*Primary Examiner* — Mohammed S. Alawadi
(74) *Attorney, Agent, or Firm* — Nolte Lackenbach Siegel; Myron Greenspan

(57) ABSTRACT

An apparatus and method for continuous operation for the production of conductors that include twisted or stranded wires or filaments includes supply payoff for providing a plurality of strands that have been work hardened. The wires or strands are annealed in line with the payoff and subsequently cooled by a chiller in line with the annealer for cooling the annealed strands output from the annealer to a predetermined temperature. A strander in line with the annealer and cooler or chiller is provided for imparting at least one twist to the annealed and cooled strands. Speed control, for example a dancer, is provided in line between the cooler and the strander for adjusting and controlling the speed or velocity of the strands moving along the line to maintain a speed compatible with the take up speed of the strander. The predetermined temperature is selected to be the ambient operating temperature of the strander for copper or aluminum cable.

8 Claims, 1 Drawing Sheet

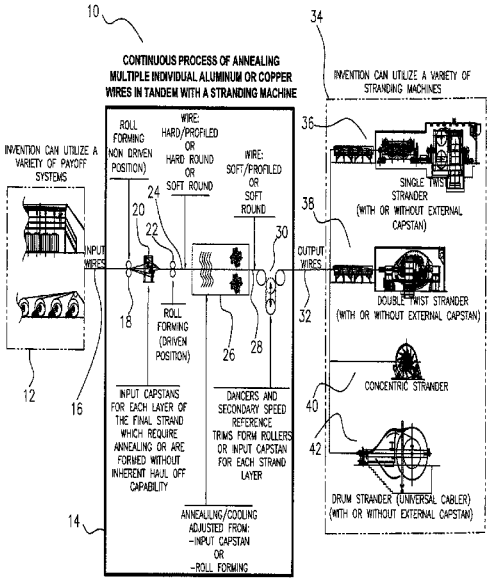

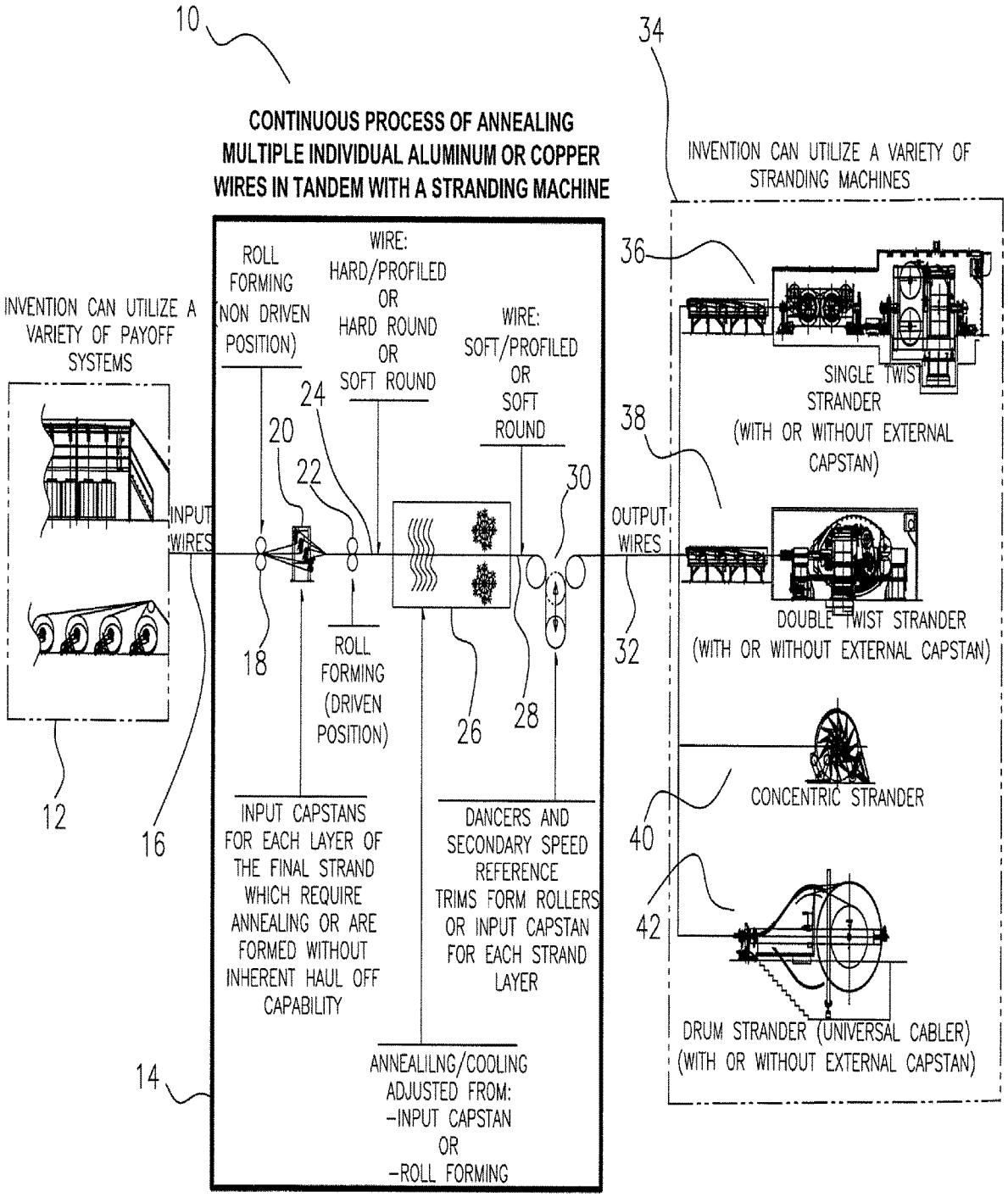
10
CONTINUOUS PROCESS OF ANNEALING MULTIPLE INDIVIDUAL ALUMINUM OR COPPER WIRES IN TANDEM WITH A STRANDING MACHINE
34
INVENTION CAN UTILIZE A VARIETY OF STRANDING MACHINES
INVENTION CAN UTILIZE A VARIETY OF PAYOFF SYSTEMS
ROLL FORMING NON DRIVEN POSITION)
WIRE: HARD/PROFILED OR HARD ROUND OR SOFT ROUND
WIRE: SOFT/PROFILED OR SOFT ROUND
36
SINGLE TWIST STRANDER (WITH OR WITHOUT EXTERNAL CAPSTAN)
38
INPUT WIRES
OUTPUT WIRES
DOUBLE TWIST STRANDER (WITH OR WITHOUT EXTERNAL CAPSTAN)
ROLL FORMING (DRIVEN POSITION)
CONCENTRIC STRANDER
INPUT CAPSTANS FOR EACH LAYER OF THE FINAL STRAND WHICH REQUIRE ANNEALING OR ARE FORMED WITHOUT INHERENT HAUL OFF CAPABILITY
DANCERS AND SECONDARY SPEED REFERENCE TRIMS FORM ROLLERS OR INPUT CAPSTAN FOR EACH STRAND LAYER
DRUM STRANDER (UNIVERSAL CABLER) (WITH OR WITHOUT EXTERNAL CAPSTAN)
ANNEALILNG/COOLING ADJUSTED FROM: -INPUT CAPSTAN OR -ROLL FORMING
12
16
14
18
20
22
24
26
28
30
32
40
42

METHOD OF ANNEALING MULTIPLE INDIVIDUAL ALUMINUM AND COPPER WIRES IN MACHINE LINE IN TANDEM WITH A STRANDING MACHINE FOR CONTINUOUS OPERATION

CROSS-REFERENCE TO RELATED APPLICATION

This application claims priority to U.S. Non-Provisional patent application Ser. No. 16/685,006 filed Nov. 15, 2019, having the same inventorship and title as the instant application, the contents of which are incorporated herein by reference. All available rights are claimed, including the right of priority.

BACKGROUND OF INVENTION

1. Field of Invention

The present invention generally relates to machinery for wire and cable production and, more specifically, a machine line and method of annealing multiple bare non ferrous wires of copper or aluminum or alloys thereof, in tandem with a standing machine for continuous single pass operation in the production of finished stranded conductors.

2. Description of Related Art

Various stranding machines have long been known and developed to assemble non-ferrous filaments, strands or wires by helically applying them together to form a multi element electrical assembly of stranded conductors. The sizes and numbers of the individual wires are varied to achieve cross sectional areas to suit the electrical conductivity requirements of the finished stranded conductor. The use of one large wire to achieve the required cross sectional area would result in the cable being too rigid and unable to bend in service or during installation. The stranding of smaller diameter strands or wires is required to help maintain the flexibility of the finished conductors. The individual wires that enter the strander are typically round or formed into a non circular profile. These wires may or may not be in an annealed state when they enter the strander.

Methods have long been utilized to form the individual wires into non circular cross sections in tandem with the stranding process (e.g: U.S. Pat. No. 4,599,853). However, when using this method, the completed strand must be batch annealed after the stranding operation.

Additionally, the method of preforming and pre-annealing profiled wire in a separate manufacturing operation is also covered in multiple patents. An example of this is U.S. Pat. No. 5,554,826. Again, the methodology disclosed in this patent covers the sequence of distinctly separate and interrupted manufacturing steps or operations, typically performed at different times and frequently at different manufacturing sites.

It is also a well known practice to reduce the overall diameter of the assembled strand by passing the assembled strand through a forming die or forming rollers that deform the strand and create an overall substantially round or circular strand circumference. This may be done sequentially on one or more of the layers as the strand is being built up. For some products, no forming is required during stranding and only a closing die is needed that imparts little or no deformation.

When deformation occurs in the individual wires or the strand as a whole or in part, the material work hardens resulting in a loss of electrical conductivity and an increase in stiffness that may result in an out-of-spec or un-merchantable product. With some products measures are taken to limit the amount of wire and product deformation to seek to maintain flexibility and conductivity. When this is not possible, it is standard industry practice to remove the finished reels of product from the strander and load them into an oven where they are thermally annealed to restore flexibility and conductivity.

In the cable industry, the goal has traditionally been to maximize the throughput of stranded cable. Drawing machine companies have achieved throughputs of 6,000 to 8,000 feet per minute. However, drawing the wires, filaments or strands typically hardens the metals and makes them less ductile and less conductive. Annealing has, accordingly, been used to improve the qualities of the wires. Therefore, to achieve throughputs of 6,000-8,000 feet per minute this has also required cooling of the drawn and annealed wires to stabilize the wires and make them less susceptible to damage. Also, the achievable high throughputs in the drawing machines and annealing stations are not compatible with the stranders since the stranders are the slowest machines in a cabling line. Also, when the wires are too hot they can be damaged within a strander which presents the harshest conditions to the wire, filaments or strands during stranding.

In accordance with the invention, the temperature of the annealed elements is reduced in a chiller or a cooling station to reduce the temperatures from 800-900° to approximately 100° ambient temperature prior to closing in the strander. This is suitable, for example, for aluminum and copper wire. Clearly, the objective is to obtain a ambient temperature and the cables are less susceptible to damage. Stranders are the harshest process through which the cables go through in the line and harsher than the drawing process.

If the wires are formed annealing preferably takes place after the forming operation but before stranding.

The present invention eliminates the need to use post-stranding annealing for approximately 8-9 hours that consumes a substantial amount of additional energy. Less energy, therefore, needs to be used to produce the same throughput of cable since no post stranding annealing is required.

For finished stranded conductors that require an increase in electrical conductivity and/or an increase in flexibility, it is standard industry practice to batch anneal the strand using a thermal process that is performed subsequent to the stranding operation. Such added but necessary manufacturing step, is generally undesirable as it increases cost, requires significant energy, and risks product damage due to the additional handling and transport of the stranded conductors. Attempts have been made to anneal the finished, assembled, stranded conductors inline with the stranding step. However, to the applicant's knowledge such attempts have been unsuccessful.

SUMMARY OF THE INVENTION

Accordingly, it is an object of the invention to provide an apparatus and method that enable annealing of some or all individual strands, wires or conductors prior to closing of the strands in tandem with a strander in a continuous uninterrupted machine line operation.

It is another object of the invention to produce a highly conductive and flexible stranded conductor upon completion of the stranding process in a continuous single pass operation without the need to complete the finished conductor in multiple operations at different times and/or different manufacturing sites.

It is yet another object of the invention to eliminate the requirement of post stranding annealing.

It is an additional object of the invention to facilitate the efficient production of Single Input Wire (SIW) compact Aluminum and SIW Copper conductors.

It is yet an additional object to provide an apparatus on method as in the previous objects that eliminates the need for batch annealing post stranding.

An apparatus and method for continuous production of twisted or stranded conductors including a plurality of wires comprising supply means for providing a plurality of strands that have been work hardened; annealing means in line with said supply means for annealing said strands; cooling means in line with said annealing means for cooling annealed strands output from said annealing means to a predetermined temperature; a strander in line with said annealing and cooling means for imparting at least one twist to the annealed and cooled strands; speed control means in line between said cooling means and said strander for adjusting and controlling the speed or velocity of the strands moving along the line to be compatible with the take up speed of said strander.

BRIEF DESCRIPTION OF THE DRAWINGS

The above and other aspects, features and advantages of the present invention will be more apparent from the following description when taken in conjunction with the accompanying drawings, in which:

The single FIGURE is a diagrammatic representation of a machine line and method of annealing multiple individual aluminum and copper wires in Tandem with a stranding machine for continuous operation in accordance with the invention. The FIGURE shows a continuous machine line for manufacturing stranded conductors or cables using different wire payoff systems and an annealer station for annealing the conductors prior to stranding by any of a variety of different stranding machines.

Referring now to the single FIGURE, anneal line in accordance with the present invention is generally designated by the reference numeral 10.

The machine line 10 includes a variety of payoff systems 12. Normal conventional payoffs can be used.

The plurality of strands or filaments 16 are fed to an annealing and cooling station 14. The cooling station 14 may include forming rollers 18 that may be non-driven rollers. The wires that have been formed are input to a capstan 20 for each layer of the final strand that requires annealing or formed without inherent haul off capability.

The output of the input capstan 20 is fed to forming rollers 22 that may be driven. The output of the forming rollers 22, at 24, may be hard/profiled or hard round or soft round. These formed wires, strands or filaments are passed through an annealing and cooling station 26. The speed at which the strands or wires are moved through the annealing and cooling station 26 can be adjusted in any suitable or conventional manner. Typically, the speed of the strands or filaments through the annealing and cooling station is in the range of approximately 100-400 feet per minute. The cooled wires at the exit point of the unit 26 are drawn by dancers to control the speed of movement of the wires or filaments moving along the line. The dancers may take the form of trim form rollers or input capstans.

Having been cooled at the output of station 14, the wires at 32 may be directed to anyone of a number of different stranders. The reference numeral 34 represents a variety of different stranding machines any one of which can be used with the invention. Thus, for example, a single twist strander (with or without an external capstan) 36, a double twist strander 38 with or without an external capstan) a concentric strander 40 or a drum strander (universal cabler) (42 with or without external capstan) can be used.

For the purpose of the present invention and this application the term "sequenced" operation is an operation in which distinctly separate and interrupted manufacturing operations or steps are performed at different times and/or different manufacturing sites. For the purposes of the present invention and this application the term "continuous" operation is an operation in which all the machinery in an entire line operates in a continuous fashion and the various manufacturing operations or steps are not interrupted nor performed at different times and/or different manufacturing sites. The machine line 10 presents a continuous line suitable for annealing multiple individual aluminum and copper wires in tandum with a stranding machine for a continuous operation. Thus, the stranding machine, whichever one is utilized, is arranged in tandem with the upstream machinery to transfer wire directly after it is released or output by the annealing and cooling station 14 in accordance with one presently preferred embodiment. The following are additional details of the above-described machine line.

The wires handled in the line are either copper or aluminium or alloys thereof.

A variety of payoff systems may be utilized depending on the manufacturers facilities, requirements and processes. In all cases the payoff system feeds the strander with input wires in various configurations.

The input wires affect the extent to which the invention is utilized.

The input wire(s) exit the payoff system 12 in a multitude of configurations on route to the annealing and cooling station 14 and the subsequent stranding process at 34. The details of the wire configurations includes but are not limited to the following:

- round soft;
- round hard;
- round partially soft/partially hard;
- profiled (trapezoidal, square, oval, rectangular etc) soft;
- profiled (trapezoidal, square, oval, rectangular etc) partially soft/partially hard;
- profiled (trapezoidal, square, oval, rectangular etc) hard;

The input wires at 16 may or may not require to be annealed at 14 in order to be stranded. If for example, round wires are not work hardened and do not require annealing, and they will remain substantially round in the final strand, they can bypass the annealing and cooling station 14 and go directly to the strander.

However, in the event that forming will be performed on the aforementioned wires, these wires will need be annealed prior to stranding to avoid annealing after stranding. Annealing of individual, formed (drawn, rolled etc) wires prior to stranding is often done in a separate operation which is independent, not in tandem with the stranding operation (See for example U.S. Pat. No. 5,554,826)

As indicated numerous patents exist that relate to inline annealing of individual and multiple wires that are taken up onto a variety of take-up packages, such as stems and reels which become pay-off packages for subsequent, and separate manufacturing operations such as stranding. However it is the in-line annealing of multiple wires directly into the strander that is the focus of this invention.

One benefit of the cable invention is that it eliminates the need for post stranding batch heat treatment of the finished reel of cable. Another benefit of the invention is that the wires delivered to the stranding operation do not necessarily need to be heat treated (annealed, tempered etc) and/or shaped before being brought to the stranding operation. This results in a reduced overall process and conversion time and cost for the strand.

Yet another benefit of the invention is that it facilitates the production SIW Compressed and Compact Copper and SIW Compressed and Compact Aluminum strands without the need to anneal after stranding.

The utilization of the invention can be divided into 2 Categories:

Category 1

Input wires that are brought to the payoff area of the stranding operation that are preformed to final (or substantially final) strand configuration or round, and require annealing. These wires will travel over a capstan or haul off device which will feed the annealer. The capstan/haul off device speed will be substantially defined by the speed requirements of the strander in order to substantially follow the strander. The annealer will then, follow the capstan/haul off device speed. The wires will be cooled to a temperature suitable to maintain wire strength and be acceptable for stranding process. To avoid stretching and overloading the hot, weak wire in the annealer system, the speed and tension is adjusted/trimmed by the dancer 30 immediately following the annealing section and prior to strand closing and stranding 34. The dancer 30 is utilized between the annealing/cooling process and the strander at 34 in order to precisely control the speeds and tensile loads on the wire during operation.

Category 2

Input wires that are not formed to final (or substantially final) strand configuration upon exiting the payoff system 12 but are formed upon entry to the annealing and cooling station 14 and do require annealing. These wires can be formed using a variety of methods which are not integral to the invention. If the wires are roll formed using driven rollers, no haul off device or capstan is required as the roll forming process will inherently perform that function and feed the wire into the annealing section 14.

If the wires are formed using a method that requires the wires to be pulled through the forming process (including non-driven roll forming), a haul off device will be required as described in "Category 1".

Upon exiting the forming process(es), with or without the use of a haul off device/capstan as described above, the wires enter the in line annealing area 26. The capstan/haul off device 30 and/or the driven roll forming device 22 speed will be substantially defined by the speed requirements of the strander (i.e., substantially follows the strander.) The annealer 26 will then follow the capstan/haul off device's speed. Subsequent to the annealing section 26, the wires will be cooled to a temperature suitable to maintain wire strength and be acceptable for the stranding process. To avoid stretching and overloading the hot, weak wire in the annealer system, the speed and tension is adjusted/trimmed by the dancer 30 immediately following the annealing section and prior to strand closing and stranding at 34. The dancer 30 is utilized between the annealing/cooling station 26 and the strander at 34 in order to precisely control the speeds and tensile loads on the wire during operation.

The wires that enter the strander are of a geometry substantially as required in the final strand and are in an annealed state as required to meet the final strand specifications. The wires can be assembled in the strander without the requirement of subsequent annealing of the take up package.

The stranding machine used, as indicated, may be any conventional strander.

A variety of stranding machines can be utilized to receive the output wires described above. These types include, but are not limited to:

Double Twist Strander;

Single Twist Strander (with or without external capstans);

Concentric/Central Strander;

Drum or "Universal Strander".

While the invention has been shown and described with reference to certain embodiments thereof, it will be understood by those skilled in the art that various changes in form and detail may be made therein without departing from the spirit and scope of the invention as defined by the appended claims and their equivalents.

What is claimed:

1. A method of continuous production of twisted or stranded conductors including a plurality of wires along a machine line comprising the steps of supplying at a selected speed a plurality of strands that have been work hardened; inline annealing said strands; inline cooling the annealed strands following said annealing step to a predetermined temperature; inline stranding on a strander with the annealing and cooling steps for imparting at least one twist to the annealed and cooled strands; controlling the selected speed of the strands along the machine line for adjusting and controlling the selected speed of the strands moving along the line to be compatible with a take up speed for stranding, said steps being performed in succession without interruption to provide continuous operation.

2. The method of continuous production as defined in claim 1, wherein said predetermined temperature is less than 100° F.

3. The method of continuous production as defined in claim 1, wherein said strander operates at an ambient temperature T and said predetermined temperature is substantially equal to T.

4. The method of continuous production as defined in claim 1, wherein said strander operates at an ambient temperature T and said predetermined temperature is less than T.

5. The method of continuous production as defined in claim 1, wherein said plurality of wires are aluminum wires.

6. The method of continuous production as defined in claim 1, wherein said plurality of wires are copper wires.

7. The method of continuous production as defined in claim 1, wherein pre-formed wires or pre-formed strands are dispensed prior to annealing.

8. The method of continuous production as defined in claim 1, wherein round wires or round strands are dispensed that need to be formed, and further comprising the step of forming said round wires located in line between a supply means and an annealing means.

* * * * *